United States Patent [19]

Gerlach et al.

[11] Patent Number: 4,562,369

[45] Date of Patent: Dec. 31, 1985

[54] COMMUTATOR AND METHOD OF MANUFACTURE THEREOF

[75] Inventors: Heinz Gerlach, Ehningen; Lothar Wörner, Stuttgart, both of Fed. Rep. of Germany

[73] Assignee: Kautt & Bux KG, Fed. Rep. of Germany

[21] Appl. No.: 686,628

[22] Filed: Dec. 31, 1984

Related U.S. Application Data

[63] Continuation of Ser. No. 332,535, Dec. 21, 1981, abandoned.

[30] Foreign Application Priority Data

Dec. 22, 1980 [DE] Fed. Rep. of Germany ..... 3048470

[51] Int. Cl.[4] ..... H01R 39/16; H01R 39/52; H01R 43/06

[52] U.S. Cl. ..... 310/235; 29/597; 310/42; 310/43; 310/236

[58] Field of Search ..... 29/597; 310/233-237, 310/42, 43

[56] References Cited

U.S. PATENT DOCUMENTS

| | | | |
|---|---|---|---|
| 2,221,571 | 12/1940 | Brecht | 310/236 |
| 2,426,042 | 8/1947 | Mueller | 310/236 |
| 2,795,841 | 6/1957 | Eppich | 310/236 |
| 3,290,527 | 12/1966 | Habermann | 310/233 |
| 3,450,914 | 6/1969 | Demerciere | 310/236 |
| 4,349,759 | 9/1982 | Arnold | 310/233 |

FOREIGN PATENT DOCUMENTS

| | | | |
|---|---|---|---|
| 852412 | 10/1952 | Fed. Rep. of Germany | 310/233 |
| 1901728 | 5/1970 | Fed. Rep. of Germany | 310/233 |
| 2019200 | 11/1971 | Fed. Rep. of Germany | 310/235 |
| 2132929 | 12/1972 | Fed. Rep. of Germany | 310/233 |
| 0050087 | 1/1932 | Norway | 310/233 |
| 0814679 | 6/1959 | United Kingdom | 29/597 |
| 0962317 | 7/1964 | United Kingdom | 310/233 |
| 0716093 | 2/1980 | U.S.S.R. | 310/233 |

*Primary Examiner*—Carl E. Hall

*Attorney, Agent, or Firm*—Wigman & Cohen

[57] ABSTRACT

A commutator includes a hub, a segment set having armoring and an inner cover surface, and insulation arranged between the hub and the segment set. The segment set is forcefittingly coupled with the hub by support forces directed toward its inner cover surface. The result of this arrangement is that the hub and the insulation are radially prestressed by tension forces caused by the armoring of the segment set.

28 Claims, 14 Drawing Figures

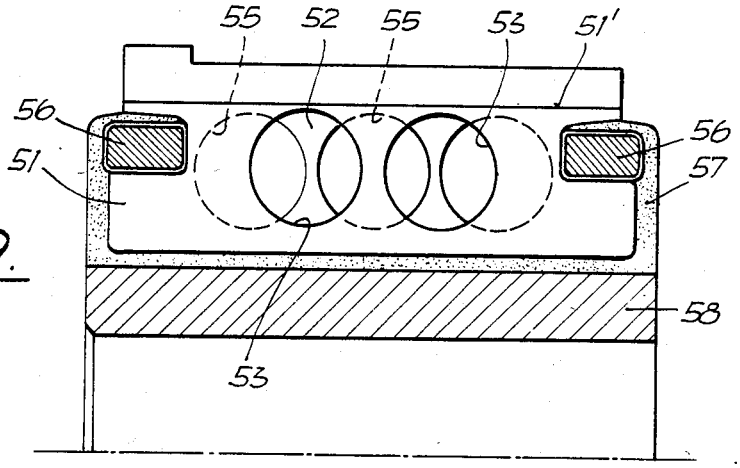
Fig. 9.
Fig. 10.
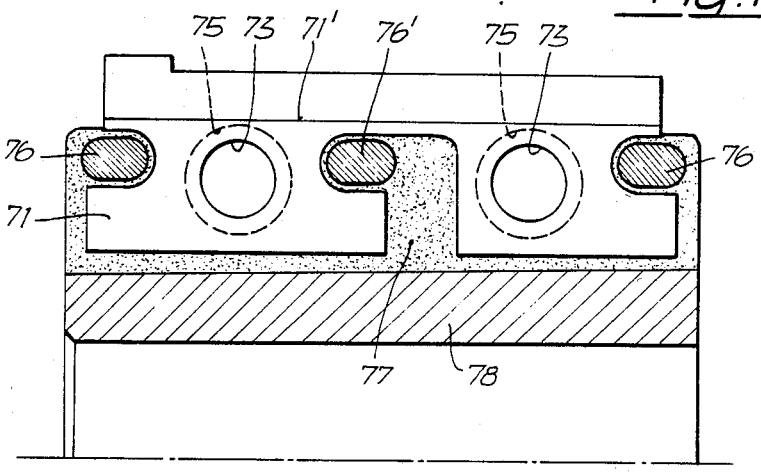

COMMUTATOR AND METHOD OF MANUFACTURE THEREOF

This application is a continuation of application Ser. No. 332,535, now abandoned, filed Dec. 21, 1981.

BACKGROUND OF THE INVENTION

1. FIELD OF THE INVENTION

The invention relates to a commutator with an armored segment set arranged on a hub or anchor shaft with an insulating layer disposed therebetween, as well as to a method for the manufacture of such a commutator.

2. DESCRIPTION OF THE PRIOR ART

Known commutators having armored segment sets are of the arch-thrust type construction. With this construction so-called breaks, which sometimes occur at high revolutions, can be avoided, even under high centrifugal loads, because the arch-thrust pressure can be made so great that the surface compression between the segments and insulating layers arranged between adjacent segments is sufficient under any operating conditions to reliably prevent the segments from moving radially outwardly. Often, however, commutators are subjected not only to large centrifugal forces, but also to high thermal loads. The deformation of the brush contact surfaces that takes place as a result of the heating of the commutator which deformation is reversible and is in the form of short and/or long wave deviations from the cylindrical shape, thus limits the maximum rpm at which the commutator can be used. The previously employed methods for avoiding or minimizing the thermal deformation of the brush contact surface, particularly an increase in the arch-thrust, have brought no success.

The basic object of the invention is to create a commutator of the above described type, which has no or at least a significantly smaller heat deformation than the known commutators.

The solution according to the invention originates from the recognition that in commutators of the arch-thrust type, the radial forces emanating from the armored segment set resulting from the arch-thrust are of varying magnitudes because of the unavoidable material inhomogeneity and dimensional non-symmetry of the segment set over the circumference or length thereof. They cause balancing adjustments which are different for each commutator, with corresponding distortion of the segment set even during its manufacture. The deformation caused by the distortion of the segment set is indeed eliminated by machining on a lathe the finished commutator, but the varying magnitudes of the radial forces over the length of the segment set remains. A new deformation of the segment set and thereby of the brush contact surface is therefore preprogrammed and occurs under all types of operating loads as a result of the weak reaction forces of the armor elements, which are especially formed to endure centrifugal forces and to maintain a sufficient arch-thrust, but are much less resistant to bending.

Even as a result of the load from the centrifugal force, the radial forces existing over the length of the segment set in nonuniform magnitudes together with the radial components resulting from an unavoidable imbalance of the segment set, as a consequence of constant expansion of the segment set caused by increasing rpms, result in an increase in the differences in magnitude of the radial forces over the length of the segment set. The continuous heat-up of the commutator occuring during operation until operating temperature is reached causes a further increase of the difference in magnitude of the radial forces acting over the length of the segment set. This increase of the difference in the magnitude of the radial forces during heating occurs by superimposed forces caused by means of the heat-dependent arch-thrust increase and by means of the increasing asymmetry of the segment set resulting from the pressure and heat increase and from the inhomogeneity of the segment set, particularly of the insulating layers. In addition, there arises the fact that, because of the relatively soft, orthotropic segment set, the build-up or decrease in the radial forces acting over the length of the segment set and arising from changes in operating conditions takes place over a relatively long way. In other words, with the onset of centrifugal force and particularly heat-loading, the force balancing adjustment takes place over a correspondingly large expansion of the segment set, which thereby increasingly loses its original shape and orientation to the commutator hub and is at least still connected only with the commutator hub or the shaft, as a result of the deformation, by local, uncontrolled contact with the commutator hub.

In order to prevent these deformations in commutators of the arch-thrust construction, such commutators must thus have a high degree of material homogeneity and dimensional symmetry. The realization of the requirements necessary therefor, such as angle trueness and identical thickness of all segments, largely tolerance-free insulating layer thickness, homogeneous material and the most ideal possible axial and radial symmetry in the construction of the segment set during its manufacture and up to completion of the commutator, would, to the extent they would even be possible, result in high costs.

SUMMARY OF THE INVENTION

For the commutator according to the invention, however, a higher degree of material homogeneity and dimensional symmetry is not necessary, as it is in the known commutators of the arch-thrust construction, so that the segment set causes only the normal manufacturing costs. The reason why, despite the above, no disturbing deformation of the brush contact surface occurs even under dynamic and thermal loads is due to the fact that the commutators shape is controlled largely by the radially prestressed hub and/or anchor shaft, which is included in the mechanical construction of the commutator as an active structural element. Its extremely hard spring characteristic and the high potential energy, given to the hub and/or shaft during manufacture of the commutator result in the fact that even slight deformations of the segment set bring a strong reaction, i.e., a strong change in the radial support force directed against the inner cover surface of the segment set originating from the hub and/or shaft. This means that the support force directed against the inner cover surface of the segment set by the hub and/or shaft, which is under pressure and is extremely stiff, i.e., which exerts extremely high resistance forces against any change in the shape and size of its cross section, resists the onset of any deformation by exerting significantly higher reaction forces. Advantageously, the maximal support forces are chosen to be significantly higher than their decrease as a result of the thermal and centrifugal loading of the commutator will ever require in later operation. By this means, the segment set is always oriented to the commutator hub or shaft by an intensive interior form fit and a correspondingly high reaction in the support force is assured against the onset of deformations in any later-occuring operation conditions. Any radial force tending as a result of an operating load to expand the segment set and thus the armor immediately effects a corresponding decrease of the support force of the hub or shaft on an extreme short way, i.e., an extreme small expansion of the hub or shaft. This means that under operating loads there is no significant tension-related increase in the diameter of the segment set. The arch-tension existing in the arch-trust surfaces remains largely constant over all operating conditions and the radial pressure between the armor and segment zones serving as the support therefor changes only to a limited degree. A further advantage resulting herefrom is that deviations in the roundness or eccentricity of the hub or anchor shaft caused by manufacture also have no negative effects.

Because of this characteristic of the commutator according to the invention and the associated equal radial pressure exerted by the segments against the armor under all operating conditions, a relatively small arch-thrust is sufficient to prevent the loss or radial movement of individual segments on commutators which are still cold but subjected to centrifugal loading. A significant decrease in the arch-thrust pressure with identical armoring as compared to a commutator of the known arch-thrust construction can be attained by virtue of the fact that the armored segment set is expanded to such a degree in the course of manufacture of the commutator that most of the tension in the armor pretenses the hub and/or anchor shaft form-fittedly coupled therewith and the insulation lying between it and the segment set.

In a preferred embodiment, however, the surface areas of the segments and insulating layers arranged between adjacent segments which areas are subjected to the arch tension is reduced down to a minimum level which will still meet the dynamic and manufacturing requirements. This decrease in surface area subjected to the arch tension, which can be achieved by openings and/or recesses in the segments and/or insulating layers, further reduces the radial forces which are caused by the heat generation and are dependent on the inhomogeneity and dimensional asymmetry, because the thermal expansion of the segment set or increase in the arch tension is significantly reduced due to the substantial reduction of the surface areas producing the circumferential pressure. Because of the substantial arch-thrust reduction in the heavily reduced arch-thrust surface areas, the forces in the segment set resulting from heat are greatly reduced and as a consequence of the support effect generated by the hub or shaft, the load on the ends of the segments holding the armoring is greatly reduced.

In order to make the fit of the segment set on the hub or anchor shaft as rigid as possible, or in other words, to make the coupling between the segment set and the hub or anchor shaft as tight as possible, it is effective to make the thickness of the insulation in the radial direction between the hub and shaft and the segments as small as possible, while taking into consideration the necessary electric strength and the clearance points that must be observed during manufacture. This simultaneously achieves a good heat transfer from the segment set to the hub and/or anchor shaft.

A further object of the invention is to create the simplest possible method of manufacturing the commutator according to the invention.

The invention is described in greater detail below with the aid of the exemplary embodiments illustrated in the drawings.

BRIEF DESCRIPTION OF THE DRAWINGS

FIG. 9 is a partial longitudinal section of a further exemplary embodiment;

FIG. 10 is a partial longitudinal section through an exemplary embodiment which is a variation of the embodiment according to FIG. 9;

DETAILED DESCRIPTION OF THE PREFERRED EMBODIMENTS

Figure 1:
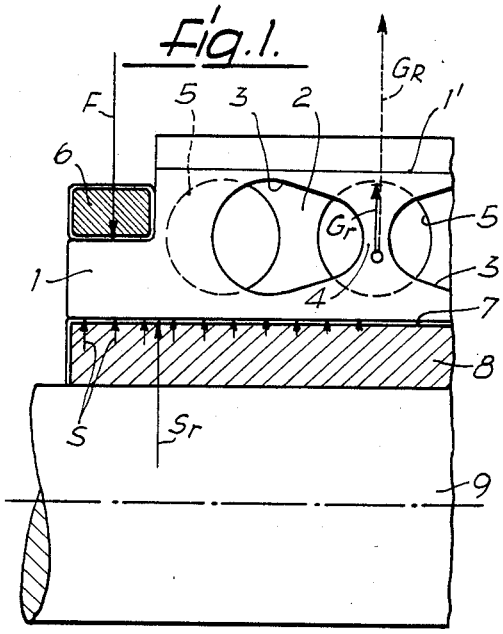
FIG. 1 is a schematic, partial longitudinal section through a commutator according to the invention illustrated with the forces which are active in the dynamically and thermally non-loaded condition.
Figure 2:
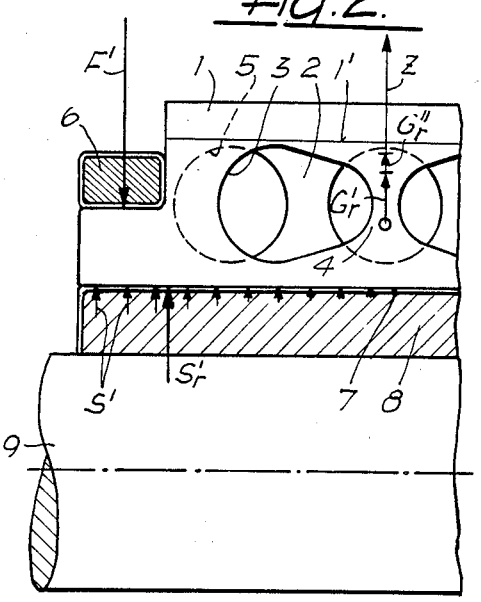
FIG. 2 is a sectional view corresponding to FIG. 1, with the forces which are active in the dynamically and thermally loaded condition.
Figure 3:
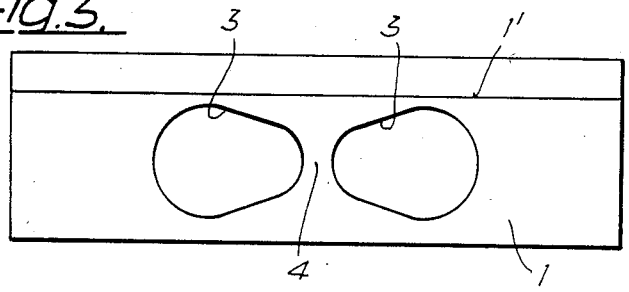
FIG. 3 is a side view of a segment for a commutator according to FIGS. 1 and 2 in condition before the turning of the circumferential stages for the armor rings onto the segment set.

The segment set of the dynamically and thermally high capacity commutator illustrated in FIGS. 1 and 2 is a hollow cylindrical body comprising segments 1 and insulating layers 2. In the segment set, one of these micanite, plate-like insulating layers 2 lies between every adjacent segments 1, which are made of copper.

Figure 4:
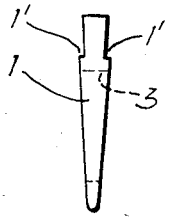
FIG. 4 is a frontal view of the segment according to FIG. 3.

The segments 1, the cross-section of which is illustrated by the cross-sectional shape in FIG. 4, have recesses 1' along both side edges thereof. Because of the recesses 1' the thickness of the edge areas of the segments is decreased to such an extent that in the finished commutator there is no longer any appreciable arch-thrust pressure in this area. In addition, the segments 1 are provided with two symmetrical openings 3 arranged in the axial direction of the commutator and spaced from each other, which are stamped out of the segment 1 and differ in their shape from an oblong hole in that they have different radiuses at their two ends. The smaller radius is provided on the end adjacent the other opening. The cross piece 4 between the two openings 3 lies in the center between the ends of the segment 1.

Figure 5:
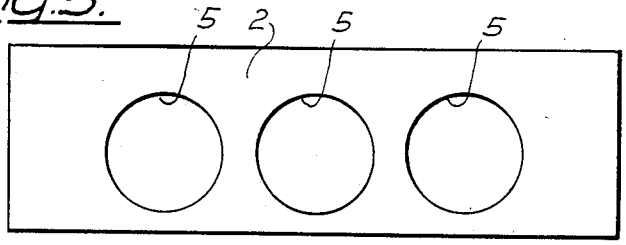
FIG. 5 is a side view of an insulating layer for the commutator according to FIGS. 1 and 2 before insertion of the annular grooves for the armor rings.
Figure 6:
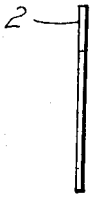
FIG. 6 is a frontal view of the insulating layer according to FIG. 5.

As shown in FIGS. 5 and 6, the insulating plates 2 each have three circular, equally large openings 5, which are disposed spaced from each other at equal distances in the longitudinal direction of the commutator. The center opening 5 lies in the center between the two ends of the insulating layer 2. It therefore lies opposite the cross piece 4. Because the center point of the curves of the openings 3 and the centers of the openings 5 are at equal distance from the inner cover surface of the segment set, there is a partial overlapping, as illustrated in FIGS. 1 and 2. In the areas of the recesses 1' the surface compression between the segments 1 and the insulating layers 2 is very slight. In the areas overlapped by the openings 3 and the openings 5, no arch-thrust pressure is transferred. An arch pressure can therefore practically only be produced in the surface areas lying between the openings 3 and the openings 5 on the one hand and the inner cover surface of the segment set on the other hand, as well as in the two end zones, each forming a step, the outsides of which abut respective insulating armoring rings 6. The step or platform for receiving the armoring rings 6 is turned in the assembled segment set in order to assure a uniform contact on all segments 1.

The armored segment set is disposed concentrically on a metallic hub 8 with insulation 7 lying therebetween and the hub 8, in turn, is disposed on a shaft 9. The insulation 7, the hub 8 and the shaft 9 are prestressed in the radial direction, whereby the latter two elements form an extremely stiff and largely homogeneous (with regard to material) and dimensionally symmetrical body, from which emanate equally large, radially symmetrical active support forces S in an almost ideal manner.

The insulation 7 may also be arranged between the shaft 9 and the inner cover surface of the segment set, said segment set being force fittingly coupled with the shaft 9 by support forces of the shaft directed toward the inner cover surface of the segment set, and said shaft 9 and said insulation 7 being radially prestressed by an essential and predeterminable part of tension forces of the armoring of the segment set.

If the hub 8 and the shaft 9 were not prestressed in the radial direction, the armored segment set would, as in the known commutators of the arch-thrust construction, sit in only form-fitting engagement on the hub 8. Then the tension force F produced by the armoring rings 6 would produce a large arch tension or arch-thrust and therefore a relatively large resulting radial force $G_R$. As a result of the expansion of the segment set under the influence of the support forces S or their radial effective resultants $S_r$, however, the radial force $G_R$ will reduce the arch tension to the significantly smaller value $G_r$.

In operation, as shown in FIG. 2, the centrifugal force Z loads the layer set in the same direction as the radial force $G'_r$ produced by the arch tension. Because the pretensed hub 8 and the pretensed shaft 9 have a very rigid spring characteristic, however, the centrifugal force Z is compensated for a corresponding reduction in the support forces S' or its radial components without any appreciable radial movement of the segment 1. The arch tension change in the reduced zones which still transfer the arch pressure is therefore quite small. Accordingly, even the difference in the magnitude of the resulting radial forces $G_r$ when the commutator is at rest and the resulting radial force $G'_r$ when it is rotating is smaller.

Because the arch tension increases as the commutator heats up is only active in the reduced zones of the segments 1 and insulating layers 2, the consequential radial force $G_r''$ is also relatively small and is compensated for by a correspondingly small reduction of the radially effective support forces $S'_r$.

The sum of all forces acting radially during operation of the commutator is only slightly higher than the sum of these forces when the commutator is at rest. This means that under operating loads no significant tension-related diameter increase of the segment set occurs, that the residual arch tension being effective in the reduced arch-thrust surfaces remains largely constant over all operating conditions, and the radial compressure between the armoring rings 6 and the end zones of the segments 1 serving as abutments therefor changes only to a small degree. Since in addition a reduction of the radially effective support forces $S'_r$ takes place basically only through the centrifugal force Z, under full operating loads, still large radial support forces S' originating from the hub are effective, countering any deformation of the segment set.

An expansion of the segment set at rest is such that the support forces at rest are higher than the decrease of said support forces caused by a deformation of the segment set as a result of dynamic and a thermal loading during operations.

Figure 7:
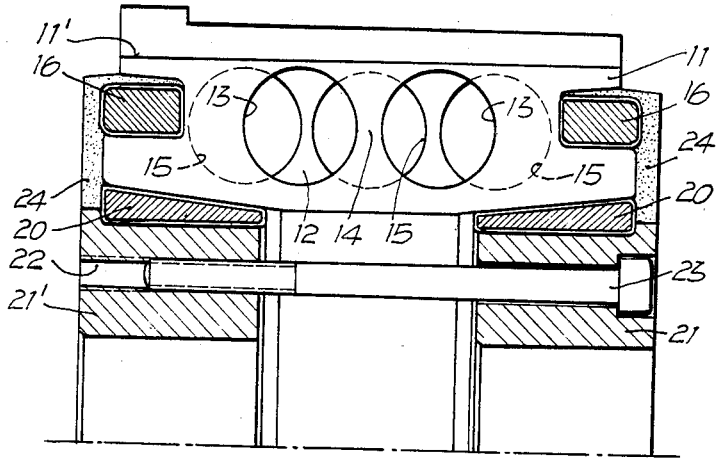
FIG. 7 is a partial longitudinal section through an exemplary embodiment of the commutator according to the invention in a construction method using tightening screws.

In the exemplary embodiment of the commutator according to the invention illustrated in FIG. 7, the segment set is comprised of alternating segments 11 and insulating layers 12. The segments 11 have recesses 11' on both sides along their outer edge zones bordering on the contact surface for the brushes. They are further provided with openings 13, which are displaced relative to openings 15 in the insulating layers 12 in such a manner that they lie opposite cross pieces 14 between the openings 15. As in the exemplary embodiment according to FIGS. 1 through 6, this limits the arch-thrust zone mainly to the area lying between the openings 13 and the openings 15 on the one side and to the inner cover surface of the segment set on the other side and to the two end zones lying within two armoring rings 16. These armoring rings 16 consist of steel and lie in frontal annular grooves with insulation disposed therebetween. Thus, the area of the segments and insulating layers subjected to the arch thrust is reduced by recesses in the segments and the insulating layers.

The two end sections of the inner cover surfaces of the segment set, which in the exemplary embodiment each extend over approximately one third of the total axial length of the segment set, each form an outwardly expanding inner cone. Two insulated support rings 20 made of steel lie on these two inner cones with their outer cover surface which forms a corresponding outer cone. The cylindrical inner cover surfaces of the two support rings 20 lie on the cylindrical outer cover surface of respective steel semi-hubs 21 and 21', the inner cover surfaces of which form a bore to receive a shaft. Penetrating bores are arranged in the semi-hub 21 parallel to the longitudinal axis of the commutator. In semi-hub 21' there are threaded bores 22 in alignment with the penetrating bores. In these bores of the semi hubs 21 and 21' are received tightening or tensioning screws 23. The plurality of screws are uniformly circumferentially distributed. As shown in FIG. 7, the semi-hubs 21 and 21' each have an annular flange which engages behind the support ring 20 arranged thereon, whereby the support rings 20 are tightened together along with the semi-hubs 21 and 21' to the same degree by means of the tightening screws 23. A cast mass 24 fills the intermediate spaces present on both frontal sides of the commutator between the armoring rings 16, the segments 11, and the insulating layers 12. This mass 24 covers the outwardly directed frontal surfaces of the armoring rings 16, the support rings 20, the end sections of the segments 11, and insulation layers 12 arranged therebetween, whereby in the exemplary embodiment the outwardly directed side of the cast mass 24 aligns with the bordering frontal surface of the semi-hubs 21 and 21'. Of course the support rings 20 can be missing, for example, when the semi-hubs 21 and 21' are relatively thin-walled due to a large bore, or when the outer cover surface formed as an exterior cone abuts the corresponding interior cone of the segment set with insulation therebetween and the semi-hubs 21 and 21' are tightened together with the tightening screws 23.

The manufacture of this commutator occurs in a manner such that the armored segment set is heated to a temperature somewhat higher than the operating temperature of the commutator. The two semi-hubs 21 and 21' are preferably pressed in together with the support rings 20 which are disposed thereon during the course of this heating. The segment set is thereby expanded until it abuts a stop ring, which holds the segment set during this manufacturing process. Preferably the support rings 20 are shrunk onto the semi-hubs 21 and 21' in order to avoid any air or space between them, their insulation layers, and the semi-hubs. The semi-hubs 21 and 21' as well as the support rings 20 are held under the press-in force until the segment set has again cooled. The inner diameter of the stop ring and the expansion of the segment set, determined by said inner diameter, is thus selected such that after the cooling of the segment set the necessary and predetermined radial pretensioning of the semi-hubs 21 and 21' and the support rings 20 by an essential and predetermined part of the tension forces of the armoring is achieved. The two semi-hubs 21 and 21' are then screwed together by means of the tightening screws 23. Finally the two frontal sides of the segment set and the support ring 20 are contained by means of the cast mass 24.

Figure 8:
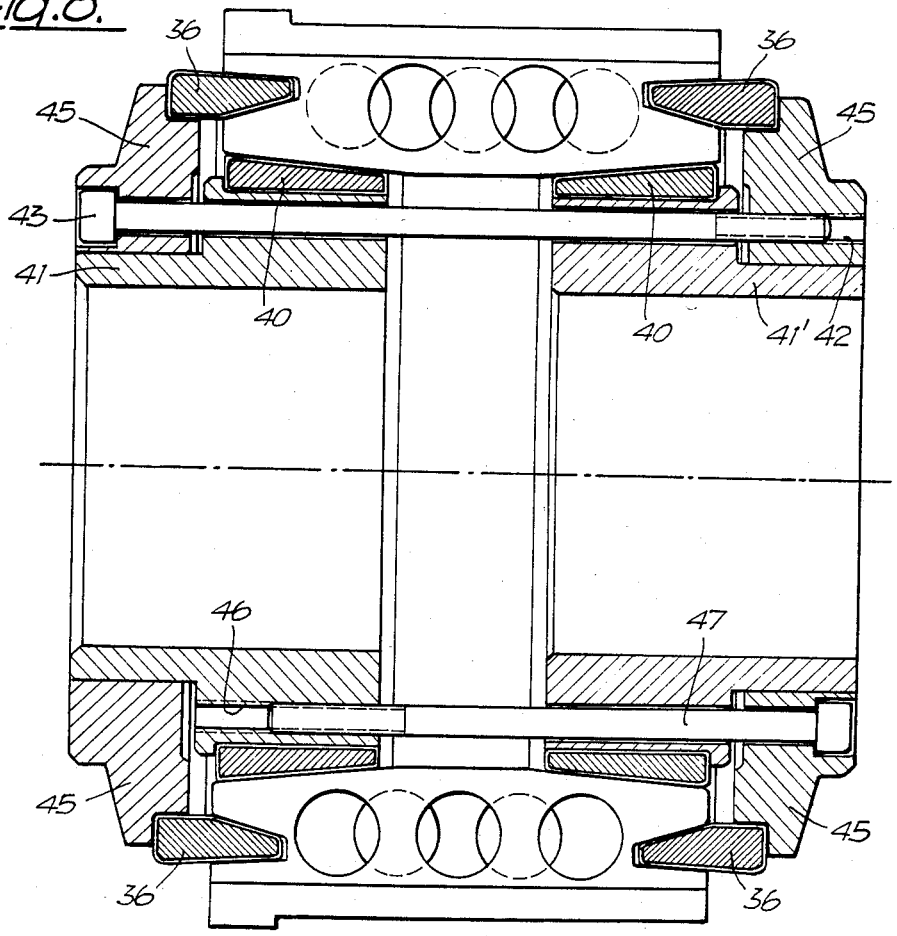
FIG. 8 is a longitudinal section through another exemplary embodiment using tightening screws.

The construction of the segment set in the exemplary embodiment shown in FIG. 8 differs from the segment set of the exemplary embodiment according to FIG. 7 only in that the two armoring rings 36 are formed as compression rings with an inner cone which abuts an outer cone formed by the inner side of the frontal annular groove of the segment set, which partially contains the armoring ring. The steel armoring rings 36, as in the other exemplary embodiments, are provided with surrounding insulation.

Figure 13:
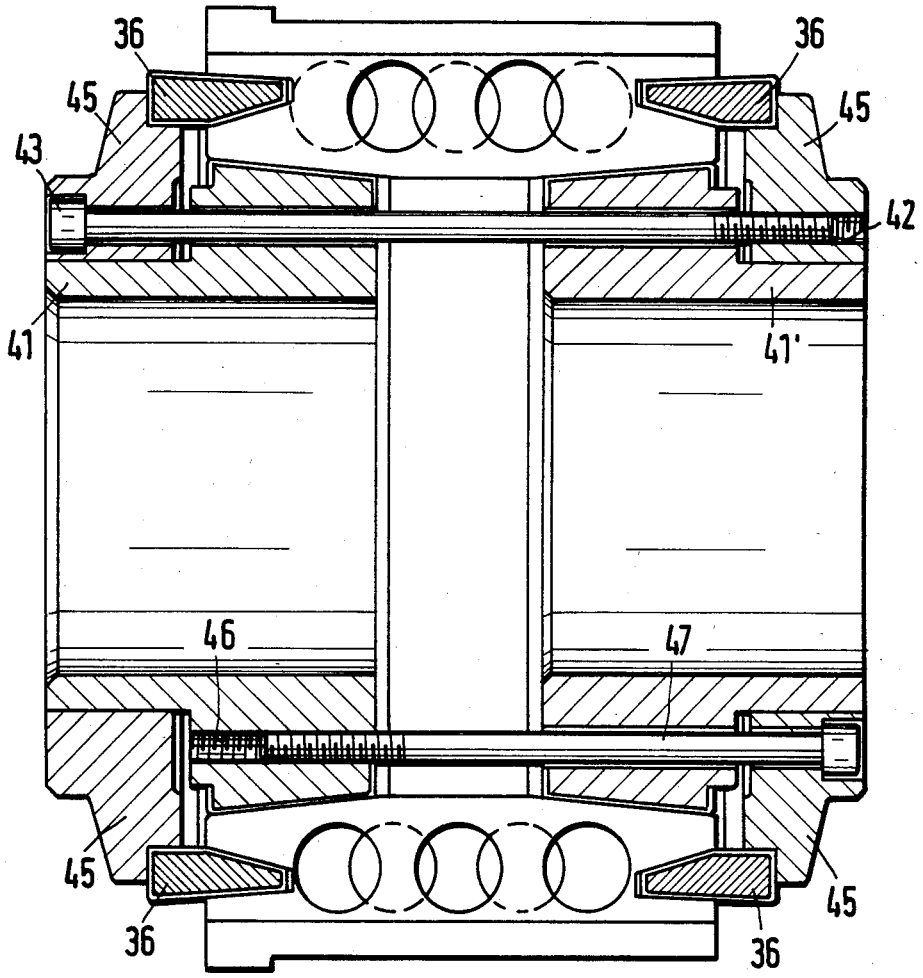
FIG. 13 is a longitudinal section through another exemplary embodiment using tightening screws.
Figure 14:
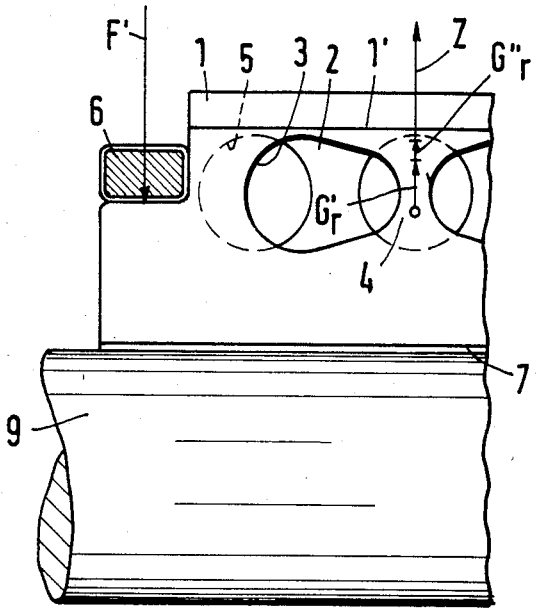
FIG. 14 is a sectional view of a commutator segment on a shaft without a hub.

A further difference from the exemplary embodiment according to FIG. 7 is the fact that on the two semi-hubs 41 and 41' a longitudinally slidable tension ring 45 is arranged on each of the two semi-hubs 41 and 41' in addition to a support ring 40. The two insulated support rings 40 are formed like the support rings 20 and are preferably shrunk onto the supporting semi-hubs 41 and 41' in order to avoid any air or space between them, their insulation layers, and the semi-hubs. An annular flange of the semi-hubs 41 and 41' also engages behind the rings 40 in order to achieve equal tightness as the semi-hubs are tightened. Each of the two tension rings 45 includes a radially outwardly projecting annular flange in connection with a cylinder surface on which the outer cylindrical portion of the inner cover surface of the armoring ring 36 lies. This annular flange abuts the outwardly directed frontal surface of the tension ring. A plurality of uniformly circumferentially distributed threaded bores 42 lie parallel to the longitudinal axis of the commutator in one of the tension rings 45. In alignment with the bores 42 are penetrating bores in the two semi-hubs 41 and 41' as well as bores in the other tension ring 45 and serve to receive respective tension screws 43, by which the two tension rings 45 and the armoring rings 36 are tightened together. In alternation with the penetrating bores the two semi-hubs 41 and 41' are provided with threaded bores 46 uniformly distributed about the circumference and lying parallel to the longitudinal axis of the commutator. Penetrating bores in the other semi-hub 41 and 41' and in the tension rings 45 are in alignment with the threaded bores 46. Tension screws 47 lie in said bores and threaded bores 46, by means of which on the one hand the semi-hub 41 and the support ring 40, the outer cone of which abuts the inner cone of the segment set and is carried by the semi-hub 41 are tightened together with the tension ring 45 on semi-hub 41' carrying the armoring ring 36. On the other hand, the semi-hub 41' and the other support ring 40 are tightened together with the other tension ring 45. The tension screws 47, which tighten together the semi-hub 41' with the tension ring 45, which is slidably arranged on the semi-hub 41 are not illustrated in FIG. 8. Each of the semi-hubs may also be formed with a conical outer cover surface which abuts the insulation on a corresponding cone formed by the inner cover surface of the segment set. See FIG. 13.

The manufacture of this commutator is accomplished in such a manner that first by means of a shrinkage process, for example, by means of a conical bushing, through which the segment set is pressed in a thick-walled cylindrical pressure sleeve, the segment set is given an arch tension. Then, by tightening the tension screws 43, the two tension rings 45 together with the two armoring rings 36 are tightened together and the armored segment set is pressed out of the pressure sleeve. The two tensioned armoring rings 36 then take over the maintenance of the arch tension in the segment set. The segment set is then heated to a temperature above that of the later operating temperature, and preferably in the course of this heating, the semi-hubs 41 and 41' as well as the support rings 40 carried thereby are pressed in with axial pressure, whereby the segment set is expanded similarly as was done in the exemplary embodiment according to FIG. 7 until it contacts a stop ring or stop sleeve holding the segment set during this manufacturing process. The two semi-hubs 41 and 41' are held under this axial pressure until they cool. The tension screws 47 are then drawn tight. The expansion of the segment set and its subsequent shrinkage during cooling give the two semi-hubs 41 and 41' as well as the support rings 40 a predetermined radial prestressing by a essential and predetermined part of the tension forces of the armoring, which prestressing does indeed reduce during operation of the commutator but is never completely eliminated.

The armored segment set of the exemplary embodiment according to FIG. 9 is distinguished from that of the exemplary embodiment according to FIG. 7 only in that the end sections of the inner cover surface are also formed cylindrically. Recesses 51' of the segments 51 and openings 53 thereof and openings 55 for the insulating layers 52, here too limit the arch tension mainly to the area lying between the openings 53 and openings 55 on the one hand and to the inner cover surface on the other hand and the two end zones lying within the armoring rings 56. Between the cylindrical outer cover surface of a steel, radially prestressed hub 58 and the inner cover surface of the segment set there is located a molded plastic or compression molding material 57, which insulates the segment set from the hub 58 and transfers the radial forces thereform. The compression molding material 57, which is a material common in the construction of compression commutators, also covers the frontal sides of the armoring ring 56 and the end zones of the layer set surrounded thereby and fills the annular groove which receives the armoring rings 56 to the extent that the rings 56 have not filled them already. To manufacture such a commutator, the armored segment set is heated to a compression tool temperature necessary for the working of the compression molding material 57, which temperature depending on the compression molding material 57, can be more than 200° C. The compression molding material 57 is spread under pressure between the inner cover surface of the segment set and the hub 58 until the outer cover surface expands into abutment against a compression sleeve containing the segment set. The inner diameter of this compression sleeve and thereby the degree of expansion of the segment set is selected in such a manner that, during cooling of the segment set and the shrinkage associated therewith, the hub 58 and the compression molding material 57 lying between it and the segment set obtain the necessary radial pretensioning.

Because this simple method of manufacture this commutator represents a particularly economical exemplary embodiment according to the invention.

The exemplary embodiment shown in FIG. 10 is, like the embodiment according to FIG. 9, a ring-armored compression commutator. It is distinguished from the latter, however, not only in that, in addition to the armor rings 76 provided at the two ends of the segment set, a third armor ring 76' is provided at mid-length, which is particularly advantageous with larger commutators. One difference lies also in the fact that the armoring rings 76 and 76' are insulated relative to the segments 71 by compression molding material 77, which during its pressurized insertion fills the intermediate space between the armoring rings 76 and 76' and the grooves containing them. The third armoring ring 76' also demands a somewhat different construction of the openings 73 in the segments and the openings 75 in the insulating layers (unnumbered) lying therebetween, as shown in FIG. 10. Because of these recesses and openings as well as the recesses 71' along both side edges of the segments 71 in this embodiment also the surface area of the segments 71 and the insulating layers (unnumbered), in which arch tension is effective, is greatly reduced.

A further difference in the exemplary embodiment according to FIG. 10 in comparison with the embodiment according to FIG. 9 is that the naked steel hub 78 has a conical outer cover surface. Instead of this one-piece hub or a shaft with an outer cone, two half-hubs with an outer cone could also be used.

The manufacture of the commutator according to FIG. 10 takes place in such a manner that first, as in a compression commutator, the pretensioned segment set in which the hub 78 is not yet in place, is pressure-filled with compression molding material 77, which thereby fully embeds the armoring rings 76 and 76'. As shown in FIG. 10, the compression molding material 77 covers the two outer armoring rings 76 as well as the end sections of the segments 71 lying therewithin completely to the outside and alignes with the hub frontal side in the exemplary embodiment. Also filled with the compression molding material 77 is the annular slot, by means of which the annular groove containing the third armoring ring 76' communicates with the inner cover surface of the segment set. The insulating layer formed by the compression molding material 77 on the inner cover surface of the segment set has a conical inner cover surface corresponding to the outer cone of the hub 78. After the filling of the segment set with the compression molding material 77 and still before its tempering, the armored segment set is heated to a temperature in excess of the latter operating temperature and this heating plus the pressing of the hub 78 preferably during the course of heating, expands the armored segment set to the degree predetermined by a stop ring or the like. During cooling the hub 78 then acquires the necessary radial pretensioning. The hub 78, which is at first maintained at a length somewhat longer than the commutator, is then turned so that is alignes with the ends of the commutator. The subsequent tempering causes the compression molding material 77 to harden.

In addition to the advantages possessed by the exemplary embodiment according to FIG. 9, the commutator according to FIG. 10 has the advantage that prestamped segments and insulating layers can be used, thus requiring no working of the segment set to manufacture the necessary seats for the armoring rings 76 and no separate insulation of the armoring rings 76 is necessary.

Figure 11:
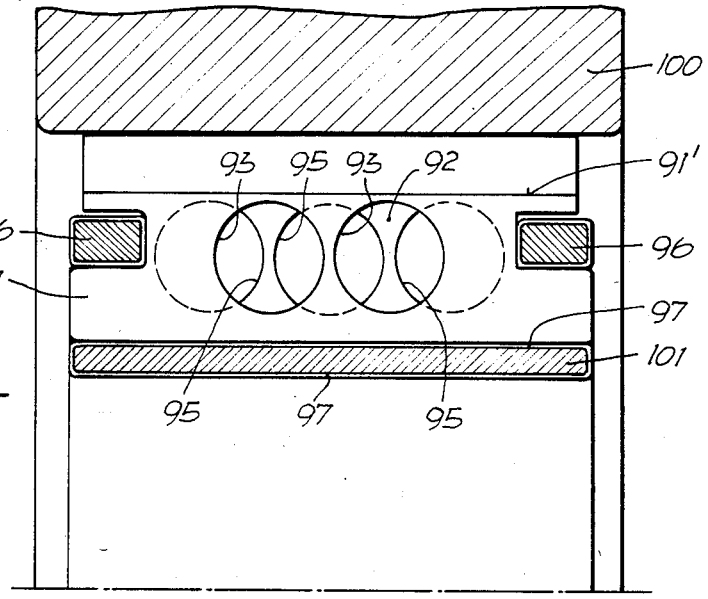
FIG. 11 is a partial longitudinal section through a fifth exemplary embodiment prior to completion.
Figure 12:
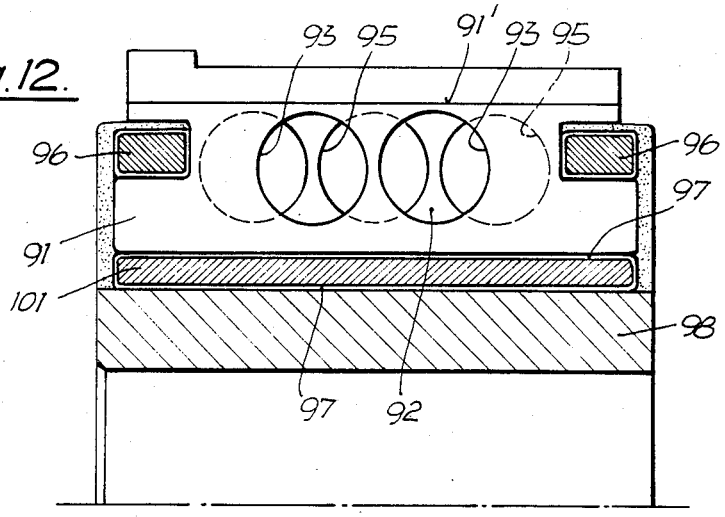
FIG. 12 is a partial longitudinal section of the fifth exemplary embodiment in the finished condition.

The exemplary embodiment illustrated in FIGS. 11 and 12 is distinguished from the previously described exemplary embodiments, particularly in that, even during the course of the diameter reduction of the segment set comprising of segments 91 with openings 93 and shoulders 91', and insulating layers 92 with punchouts 95, which reduction is necessary for effecting the arch-thrust, for example, by means of a conical sleeve through which the segment set is pressed into a compression bushing, a relatively thin-walled insulated hub sleeve 101 is shrunk into the holding bore of the segment set and is force-fittedly connected therewith. Since for the relatively soft, orthotropic segment set a relatively long shrinkage distance is necessary to build up arch tension i.e., a large diameter reduction is necessary, the amount of compression of the hub sleeve 101 by means of its diameter reduction can be determined by allowing a difference between the diameter of the receiving bore of the segment set and the outer diameter of the insulated hub sleeve 101. After it has been pressed in the compression bushing 100, an annular groove is turned into each end of the segment set to receive insulating armoring rings 96. The compression of the hub sleeve is chosed to be high enough so that, after the shrinking of the armoring rings 96 onto the segment ends made available by the annular grooves and after the removal of the armored segment set from the compression bushing 100, the segment set expands to a large degree while experiencing a significant decrease in the arch-tension and an increasing tension build-up in the armoring rings 96 because of the high support forces of the compressed hub sleeve 101. The segment set which is radially prestressed by the hub sleeve 101 is then heated. During this process a hub 98 is pressed into place.

The hub sleeve 101 which was shrunk into the segment set as a pressure sleeve could also have a slightly conical bore. The hub or anchor shaft provided with a corresponding outer cone could then be pressed into place during the course of the heating of the segment set. A conical hub has the advantage that it supports the end of the segments 91 which carry the armoring rings 96, since during the course of the heating of the segment set it was introduced into the receiving bore and placed under pressure. The coefficient of expansion of the segment set is greater than that of the steel armoring rings 96. The segments 91 therefore experience an increasing bending load at their ends during heating.

The hub sleeve 101 is surrounded by a thin insulating band in an annular spool-like cover and forms a double insulation 97 of the segment set relative to the anchor shaft or hub 98. Because of the two very thin insulating layers 97 between the segment set and the anchor shaft or hub 98, a good heat transfer to the anchor shaft or hub 98 is assured. The resulting small heat drop between the segment set and the hub or anchor shaft 98 contributes to the fact that the decrease of support forces of the hub 98 remains extremely small. This effect of a good heat transfer from the commutator to the anchor shaft or hub 98, is of course, also true for the other exemplary embodiments. Furthermore, of course the insulation can be formed by such a winding in any of the other exemplary embodiments as well.

What is claimed is:

1. A commutator comprising:

an anchor shaft;

a segment set having an inner cover surface, insulating layers between adjacent segments, and an armoring;

insulation arranged between the shaft and the inner cover surface of the segment set;

said segment set being force-fittingly coupled with the shaft by support forces of the shaft directed toward the inner cover surface of the segment set;

said shaft and said insulation being radially prestressed by an essential and predeterminable part of tension forces of the armoring of the segment set;

wherein the area of the segments and insulating layers subjected to the arch-thrust is reduced by recesses in the segments and the insulating layers;

each segment of the segment set having openings therethrough with cross pieces between adjacent openings, each insulating layer having openings therethrough with cross pieces between adjacent openings, the openings in each insulating layer being arranged opposite the cross pieces of each segment.

2. A commutator comprising:

a hub;

a segment set having an inner cover surface, insulating layers between adjacent segments, and an armoring;

insulation arranged between the hub and the inner cover surface of the segment set;

said segment set being force-fittingly coupled with the hub by support forces of the hub directed toward the inner cover surface of the segment set;

said hub and said insulation being radially prestressed by an essential and predeterminable part of tension forces of the armoring of the segment set;

wherein each segment of the segment set has openings therethrough with cross pieces between adjacent openings;

each insulating layer has openings therethrough with cross pieces between adjacent openings; and the openings in each insulating layer are arranged opposite the cross pieces of each segment.

3. The commutator according to claim 2, wherein:

an expansion of the segment set at rest is such that the support forces at rest are higher than the decrease of said support forces caused by a deformation of the segment set as a result of dynamic and thermal loading during operation.

4. The commutator according to claim 2, wherein:

said insulation, in the radial direction between the hub and the segment set, is thin.

5. The commutator, according to claim 2, wherein the area of the segments and insulating layers are subjected to the arch-thrust is reduced by recesses in the segments and the insulating layers.

6. A commutator comprising:

a hub;

a segment set having an inner cover surface, insulating layers between adjacent segments, and an armoring;

insulation arranged between the hub and the inner cover surface of the segment set;

said segment set being force-fittingly coupled with the hub by support forces of the hub directed toward the inner cover surface of the segment set; and said hub and said insulation being radially prestressed by an essential and predeterminable part of tension forces of the armoring of the segment set;

said hub being divided into two axially spaced semi-hubs which are biased toward each other;

each of said semi-hubs having a conical outer cover surface which abuts the insulation on a corresponding cone formed by the inner cover surface of the segment set;

two tension rings tightened together by screws, each tension ring being arranged on one of said semi-hubs so as to be axially slidable toward the other tension ring; and two insulated rings forming the armoring of the segment set, each having an inner cone which abuts an outer cone of an annular groove of the segment set; and said two insulated rings being axially tensioned toward each other by the two tension rings.

7. A commutator, comprising:

hub means;

a set of segments having insulating layers between them, retained together with an arch thrust between the segments and insulating layers, said segments set being arranged around said hub means and having an inner surface;

insulating means disposed between said hub means and said segment set such that support forces of the hub means are directed toward the inner surface of the segment set; and an armoring ring cooperating in tension with said segment set to retain said segment set on said insulating means such that a majority of the tension in the armoring ring is attributable to the support forces and less than a majority of the tension is attributable to the arch thrust of the segment set.

8. The commutator according to claim 7, wherein the insulating means is a molded layer.

9. The commutator according to claim 7, wherein the hub means comprises a shaft.

10. The commutator according to claim 7, wherein the hub means comprises a hub on a shaft.

11. The commutator according to claim 7, wherein the hub means has a hard spring characteristic so that a slight expansion of the segment set results in a reduction of the support forces, whereby deformation of the segment set is minimized because an increase in any radial forces tending to deform the segment set is offset by the reduction of support forces.

12. The commutator according to claim 7, wherein the segments and insulating layers have recesses therein to reduce the arch thrust.

13. The commutator according to claim 12, wherein each segment has openings therethrough with cross-pieces between adjacent openings, and each insulating layer has openings therethrough with cross-pieces between adjacent openings.

14. A commutator, comprising:

hub means;

a set of segments having insulating layers between them, retained together with an arch thrust between the segments and insulating layers, said segment set being arranged around said hub means and having an inner surface;

an armoring ring cooperating in tension with said segment set to retain said segment set on said hub means;

means disposed between the hub means and the segment set for urging the segment set outwardly away from the hub means and for applying a tensile force to the armoring ring such that a majority of the tension in the armoring ring is attributable to forces urging the segment set outwardly away from the hub means and less than a majority of the tension is attributable to the arch thrust of the segment set.

15. The commutator according to claim 14, wherein the insulating means is a molded layer.

16. The commutator according to claim 14, wherein the hub means comprises a shaft.

17. The commutator according to claim 14, wherein the hub means comprises a hub on a shaft.

18. The commutator according to claim 14, wherein the hub means has a hard spring characteristic so that a slight expression of the segment set results in a reduction of the outwardly urging forces, whereby deformation of the segment set is minimized because an increase in any radial forces tending to deform the segment set is offset by the reduction of the outwardly urging forces.

19. The commutator according to claim 14, wherein the segments and insulating layers have recesses therein to reduce the arch thrust.

20. The commutator according to claim 19, wherein each segment has openings therethrough with cross-pieces between adjacent openings and each insulating layer has openings therethrough with cross-pieces between adjacent openings.

21. A commutator comprising a hub means, a set of segments having insulating layers between them and retained together with an arch thrust between the segments and the insulating layers, an insulating means disposed between the hub means and the segment set such that radial support forces of the hub means are directed toward the segment set, and an armoring ring cooperating in tension with the segment set;

said commutator being produced by a method comprising:

locating the segment set around the hub means;

arranging the armoring ring in cooperation with the segment set so that the armoring ring is in tension and creates an arch thrust in the segment set; and disposing the insulating means between the segment set and the hub means so as to expand the segment set, thus reducing the arch thrust and increasing the radial support forces between the hub means and the segment set such that a majority of the tension in the armoring ring is attributable to the radial support forces and less than a majority of the tension is attributable to the arch thrust.

22. A commutator comprising a segment set, an armoring ring, hub means, and insulating means, disposed between the hub means and the segment set, said commutator being produced by a method comprising:

disposing the segment set around the hub means;

placing an armoring ring in tension in cooperation with the segment set so as to create an arch thrust within the segment set; and expanding the segment set so as to reduce the arch thrust and create radial support forces between the segment set and the hub means such that a majority of the tension in the armoring ring is attributable to the radial support forces and less than a majority of the tension is attributable to the arch thrust.

23. A method for manufacturing a commutator, comprising the steps of:

arranging a set of segments around a hub means;

placing an armoring ring in tension and in cooperation with the segment set so as to create an arch thrust within the segment set;

expanding the segment set so that the arch thrust is reduced and radial support forces between the segment set and the hub means are created, said segment set being expanded to the extent that a majority of the tension in the armoring ring is attributable to the radial support forces and less than a majority of the tension is attributable to the arch thrust.

24. The method according to claim 23, wherein expanding the segment set is effected by injecting an insulating molding under pressure between the segment set and the hub means.

25. The method according to claim 24, wherein the segment set is expanded while disposed within a pressure sleeve having an inner diameter greater than the outer diameter of the pre-expanded segment set.

26. The method according to claim 25, wherein the outer diameter of the segment set is expanded until it is substantially equal to the inner diameter of the pressure sleeve.

27. The method according to claim 26, further comprising the step of curing the molding until it is hard after the segment set has been expanded.

28. The method according to claim 27, further comprising the step of removing the commutator from the pressure sleeve after the molding is cured.

* * * * *

UNITED STATES PATENT AND TRADEMARK OFFICE

CERTIFICATE OF CORRECTION

PATENT NO. : 4,562,369

DATED : December 31, 1985

INVENTOR(S) : Heinz Gerlach; Lothar Wörner

It is certified that error appears in the above—identified patent and that said Letters Patent is hereby corrected as shown below:

IN THE CLAIMS:

Claim 5, line 3, delete "are".

Claim 18, line 3, delete "expression" and insert therefor --expansion--.

Signed and Sealed this

*Eighth* Day of *July 1986*

[SEAL]

*Attest:*

DONALD J. QUIGG

*Attesting Officer*

*Commissioner of Patents and Trademarks*